United States Patent [19]

Readnour

[11] Patent Number: 4,786,234

[45] Date of Patent: Nov. 22, 1988

[54] TURBINE AIRFOIL

[75] Inventor: Jack L. Readnour, Toledo, Ohio

[73] Assignee: Teledyne Industries, Inc., Los Angeles, Calif.

[21] Appl. No.: 390,193

[22] Filed: Jun. 21, 1982

[51] Int. Cl.[4] ..... F01D 9/02

[52] U.S. Cl. ..... 416/97 R; 415/115; 415/137

[58] Field of Search ..... 415/115, 116, 134–139; 416/92, 95, 97, 96 R, 96 A

[56] References Cited

U.S. PATENT DOCUMENTS

| | | | |
|---|---|---|---|
| 2,599,654 | 6/1952 | Musikant | 415/138 |
| 3,588,267 | 6/1971 | Turnditch et al. | 415/135 |
| 4,288,201 | 9/1981 | Wilson | 415/136 X |
| 4,314,442 | 2/1982 | Rice | 416/97 R X |
| 4,396,349 | 8/1983 | Hueber | 415/137 X |

FOREIGN PATENT DOCUMENTS

| | | | |
|---|---|---|---|
| 552543 | 5/1957 | Belgium | 416/97 |
| 2027496 | 2/1980 | United Kingdom | 416/96 R |

*Primary Examiner*—Abraham Hershkovitz
*Assistant Examiner*—Joseph M. Pitko
*Attorney, Agent, or Firm*—Gifford, Groh, Sheridan, Sprinkle and Dolgorukov

[57] ABSTRACT

A turbine airfoil, such as a turbine blade or nozzle vane, is disclosed for use in a high temperature environment. The airfoil comprises a center post and at least one side piece. The side piece is attached to the center post so that, at room temperature, a clearance between the center post and the side piece permits limited relative movement between the post and side piece. This clearance space, however, is dimensioned so that at the operating temperature of the turbine, thermal expansion of the center post and/or side piece substantially eliminates the clearance as well as the limited movement between the center post and side piece.

10 Claims, 2 Drawing Sheets

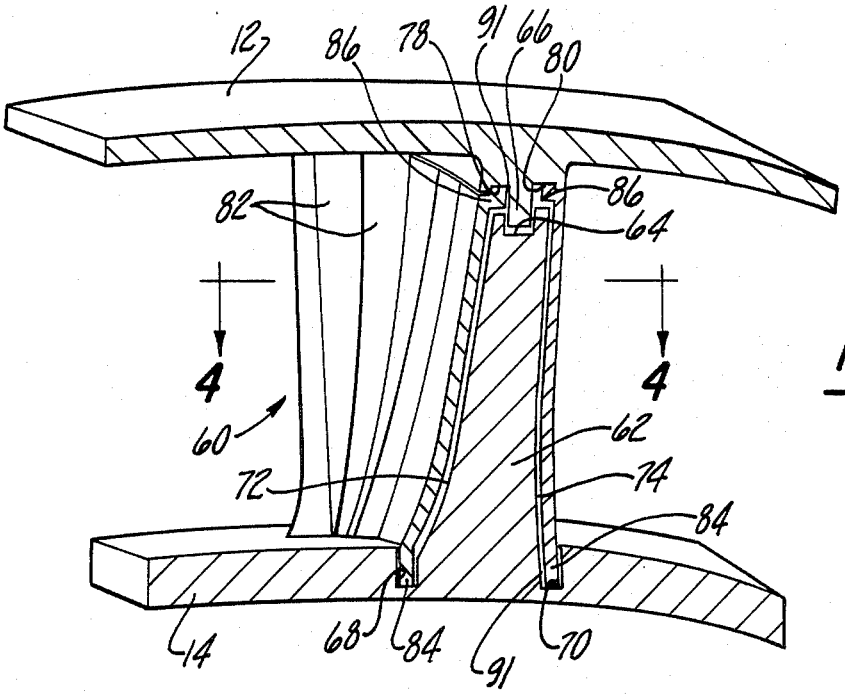
Fig-3
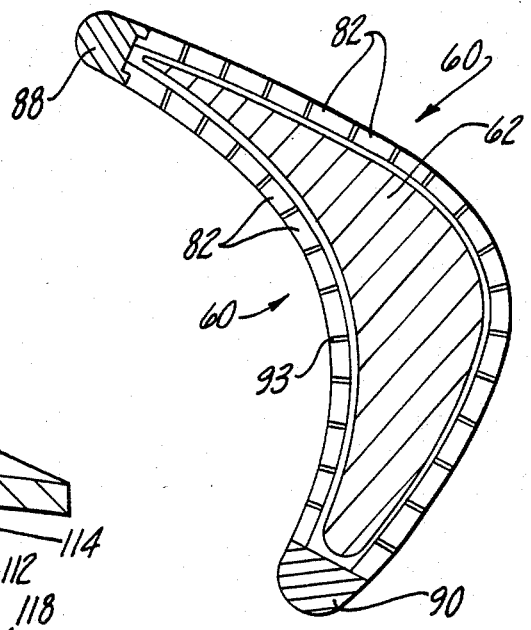
Fig-4
Fig-5
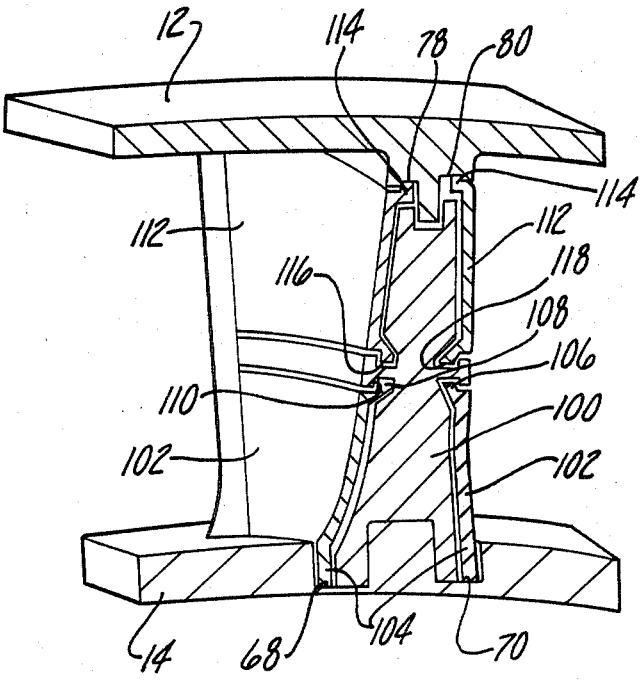

TURBINE AIRFOIL

BACKGROUND OF THE INVENTION

I. Field of the Invention

The present invention relates to a turbine airfoil construction such as a turbine blade or turbine nozzle vane.

II. Description of the Prior Art

Turbine airfoils, such as turbine blades and turbine nozzle vanes are typically constructed by casting the airfoil from metal or ceramic. Many of the previously known airfoils include a hollow interior and cooling air is circulated through the interior of the airfoil in order to cool it. This cooling air flow is ultimately exhausted into the gas stream through openings formed in the airfoil.

Under normal operating conditions, the turbine airfoil is subjected to extremely high temperatures, often in excess of 2,000° F. Since the interior of the airfoil is cooled, very high thermal gradients are formed across the turbine airfoil during the normal operation of the turbine engine. These high thermal gradients oftentimes crack the airfoil and necessitate prolonged and expensive repair of the turbine engine.

SUMMARY OF THE PRESENT INVENTION

The present invention provides a turbine airfoil which overcomes the above mentioned disadvantages of the previously known airfoils.

In brief, the turbine airfoil of the present invention comprises a center post and at least one side piece secured to the center post. The securing means forms a clearance between the side piece and center post when the side piece and center post are at room temperature. This clearance space permits limited relative movement at room temperature between the center post and side piece.

Conversely, at the elevated temperature which the airfoil is subjected to during the normal operation of the turbine engine, thermal expansion of the center post and/or side piece substantially eliminates this clearance space and, simultaneously, eliminates all relative movement between the center post and side piece.

In one preferred embodiment of the invention, the side piece substantially covers one side of the center post. A second side piece is then secured to the first side piece on the opposite side of the center post so that the center post is enclosed by the side pieces. Furthermore, the side pieces are secured together in the fashion which permits limited relative movement between the side pieces at room temperature. Thermal expansion of the side pieces at the operating temperature of the airfoil, however, eliminates most of this clearance as well as the movement between the side pieces.

The present invention thus provides a turbine airfoil comprising at least two, and preferably more, individual parts or segments which are loosely secured to each other at room temperature but which, through thermal expansion, are rigidly secured to each other at the normal operating temperature of the airfoil. As such, the thermal gradients across the airfoil during the operation of the turbine engine are not only substantially reduced but are also more evenly distributed across the airfoil in contrast with the previously known turbine airfoils.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 3 is a side view illustrating a second preferred embodiment of the present invention;

FIG. 4 is a sectional view taken substantially along line 4—4 in FIG. 3;

FIG. 5 is a side view showing a further preferred embodiment of the turbine airfoil of the present invention.

DETAILED DESCRIPTION OF A PREFERRED EMBODIMENT OF THE PRESENT INVENTION

Figure 1:
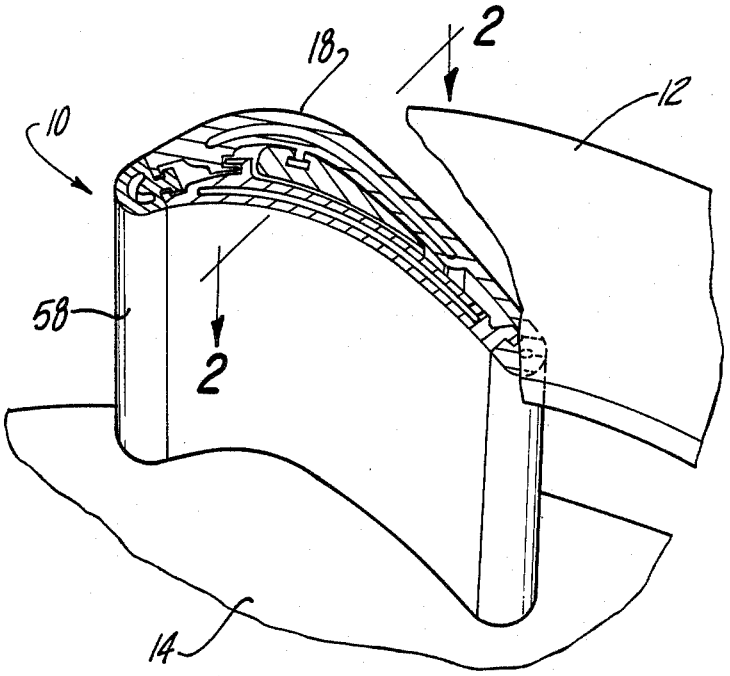
FIG. 1 is a side view illustrating a first preferred embodiment of the turbine airfoil of the present invention.
Figure 2:
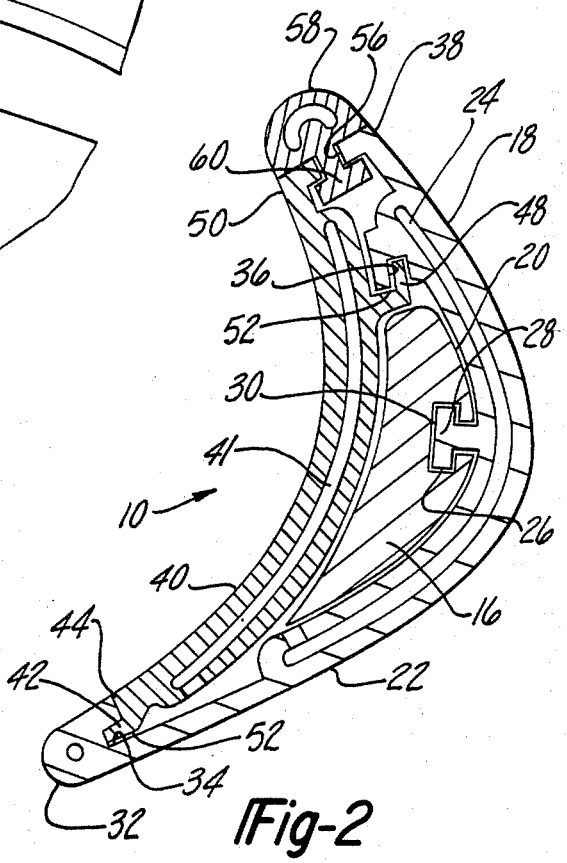
FIG. 2 is a sectional view taken substantially along line 2—2 in FIG. 1 and enlarged for clarity.

With reference first to FIGS. 1 and 2, a first preferred embodiment of the present invention is thereshown and comprises a turbine airfoil 10 which is illustrated in FIGS. 1 and 2 as a turbine nozzle vane. As such, the airfoil 10 extends between an outer turbine shroud 12 and an inner turbine shroud 14

With reference now particularly to FIG. 2, the airfoil 10 comprises a center post 16 which radially extends between the turbine shrouds 12 and 14. The center post 16 is secured to the shrouds 12 and 14 in any conventional fashion, such as by brazing, welding or integrally cast. Consequently, the center post 16 is rigid with respect to the shrouds 12 and 14.

Referring again to FIGS. 1 and 2, a side piece 18 is positioned along one side 20 of the center post 16 so that the side piece 18 covers the side 20 of the center post 16 and extends between the inner and outer shrouds 14 and 12. An outer surface 22 of the side piece 18 is curvilinear and shaped in accordance with the aerodynamic requirements of the turbine engine nozzle. In addition, a radially extending passageway 24 is formed through the side piece 18. A cooling fluid, typically air, is supplied to this passageway 24 and is ultimately exhausted out to the gas stream by openings (not shown) in the nozzle vane.

Referring now particularly to FIG. 2, a radially extending T-shaped channel 26 is formed along and open to the side 20 of the center piece 16. A radially extending T-shaped flange 28 on the side piece 18 is slidably received within the channel 26 thus attaching the side piece 18 to the center post 16.

The channel 26 and T-shaped flange 28 are dimensioned so that, at room temperature, a clearance space 30 is formed between the channel 26 and the flange 28. This clearance space 30 permits limited movement between the side piece 18 and center post 16 at room temperature. Conversely, at the normal operating temperature of the turbine engine, typically in excess of 2,000° F., thermal expansion of the center post and/or the side piece 18 substantially eliminates this clearance space 30 and simultaneously eliminates all movement between the center post 16 and side piece 18.

One end 32 of the side piece 18, which forms the trailing end of the turbine vane, includes a radially extending channel 34. Similarly, a second radially extending channel 36 is formed in the side piece 18 at a position spaced inwardly from its other or leading end 38 and both channels 34 and 36 open towards the center piece 16.

A second side piece 40 with a cooling passage 41 includes a first extension 42 at its trailing end 44 which is slidably received within the first channel 34. Similarly, a second extension 48 at position spaced inwardly from the other end 50 of the second side piece 40 is slidably received within the other channel 36 on the first side piece 18 thus securing the side pieces 18 and 40 together. The second side piece also preferably includes a cooling air passage 41.

The extensions 42 and 48 and their respective receiving channels 34 and 36 are dimensioned so that, at room temperature, a clearance space 52 is formed between each extension 42 and 48 and its channel 34 and 36. Consequently, at room temperature the side pieces 18 and 40 can move a limited amount with respect to each other. These extensions 42 and 48 and channels 34 and 36, however, are dimensioned so that, at their normal elevated operating temperature, thermal expansion of the side pieces 18 and/or 40 substantially eliminates this clearance space and rigidly secures the side pieces 18 and 40 together.

Still referring to FIG. 2, the leading ends 50 and 38 of the side pieces 40 and 18 are spaced apart from each other thus forming a channel 56 therebetween. A radially elongated nose piece 58 includes a T-shaped flange 60 along one side which is positioned through this channel 56 thus attaching the nose piece 58 to the side pieces 18 and 40. As before, the T-shaped flange 60 and channel 56 are dimensioned to provide limited movement between the nose piece 58 and side pieces 18 and 40 at room temperature but, due to thermal expansion of the nose piece 58 and/or side piece 18 and 40 at the operating temperature of the turbine engine, the nose piece 58 is rigidly attached to the side pieces 18 and 40.

With reference now to FIGS. 3 and 4, a second preferred embodiment of the airfoil of the present invention is thereshown comprising a stator vane 60 extending radially between the outer shroud 12 and inner shroud 14. The vane 60 comprises a radially extending center post 62 which is secured to or formed as a part of the inner shroud 14 and has an axially extending channel 64 formed at its outer radial end. An axially extending flange 66 protrudes radially inwardly from the outer shroud 14 and is positioned within the channel 64. The flange 66 is secured to the center post 62 in any conventional fashion, such as by brazing or welding.

Axially extending channels 68 and 70 are formed along the inner shroud 14 along each side 72 and 74 of the center post 62 so that the channels 68 and 70 are recessed into the inner shroud 14. Similarly, axially extending channels 78 and 80 are recessed into the outer shroud 12 on opposite sides of the outer shroud flange 66.

A plurality of radially elongated and narrow segments 82 each have an inner end portion 84 which is positioned within either the channel 68 or 70 on the inner shroud 14. Similarly, each segment 82 includes an outer end portion 86 which is positioned within one of the channels 78 or 80 in the outer shroud 12. As is best shown in FIG. 4, the segments 82 are positioned adjacent each other and cover the sides 72 and 74 of the center post 62. Nose pieces 88 and 90 are secured between the shrouds 12 and 14 at the leading and trailing ends of the airfoil in order to retain the segments 82 within the shroud channels 68, 70, 78 and 80.

The width of both the inner and outer end portions 84 and 86 of the segments 82 is slightly less than the width of their respective receiving channels 68, 70, 78 and 80 thus forming a clearance space 91 (FIG. 3). Similarly, a clearance space 93 (FIG. 4) is formed between the adjacent segments 82. Consequently, at room temperature, the segments 82 are movable relative to each other as well as relative to the center post 62. At the operating temperature of the turbine engine, however, thermal expansion of the segments 82 and/or shrouds 12 and 14 substantially eliminates the clearance spaces 90 and 91 thus rigidly securing the segments 82 to each other as well as to the center post 62. Therefore, the airfoil illustrated in FIGS. 3 and 4 substantially decreases the thermal stress of the airfoil and permits higher engine operating temperatures without the previously known cracking or fracture of the airfoil.

A still further modification of the present invention is shown in FIG. 5 in which a center post 100 extends between the inner shroud 14 and the outer shroud 12, being attached to the inner shroud 14 in a conventional fashion, such as by brazing or welding. As in the embodiment of the invention shown in FIGS. 3 and 4, channels 68 and 70 are formed in the inner shroud 14 adjacent each side of the center post 100 while channels 78 and 80 are formed in the outer shroud 12. Unlike the vane illustrated in FIGS. 3 and 4, however, a pair of radially inner segments 102 each have an end 104 positioned within the channel 68 or 70. The outer radial end 106 of each inner segment 102 extends approximately half way toward the outer shroud 12 and includes an axially elongated flange 108 which is positioned within a receiving channel 110 formed along each side of the center post 100. As before, a clearance space is formed between the flange 108 and its receiving channel 110 as well as a clearance space between the radially inner end 104 of each segment 102 and its receiving channel 68 or 70 when the segment 102 is at room temperature. Conversely, at the operating temperature of the turbine engine, thermal expansion of the side pieces 102 and/or the center post 100 eliminates this clearance and rigidly secures the segments 102 to the center post 100.

Similarly, a pair of outer radial segments 112 each have an outer radial end 114 positioned within the channel 78 or 80 and an inner radial end 116 positioned within an axially extending channel 118 formed along each side of the center post 100 so that the side piece segments 102 and 112 are radially adjacent each other. The outer side piece segments 112, like the inner side piece segment 102 are loosely secured to the center post 100 at room temperature but, thermal expansion of the outer segments 112 and/or the outer shroud and center post 100 rigifies the attachment of the segments 112 to the center post secured to the center post 100.

Figure 6:
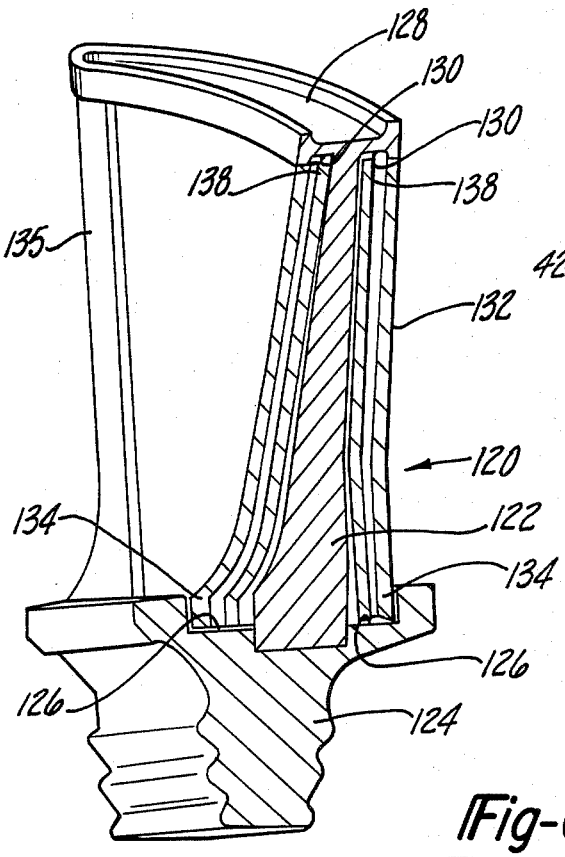
FIG. 6 is a side view illustrating a still further preferred embodiment of the present invention and with parts removed for clarity.

With reference now to FIG. 6, a still further preferred embodiment of the turbine airfoil of the present invention is thereshown and comprises a turbine blade 120 rather than a turbine nozzle vane. The turbine blade 120 includes a center post 122 which is rigidly secured by brazing or welding to a turbine blade root 124. An axially extending channel 126 is formed in the root 124 along each side of the center post 122. Similarly, a cap 123 is secured to or formed as a part of the outer radial end of the center post 122. The cap 128 forms an axial channel 130 along each side of the center post 122 and the channels 130 and 126 face each other.

A side piece 132 is attached to each side of the center piece 122 so that an inner end 134 of the side piece is positioned within the channel 126 while the outer end 138 of the side piece 134 is positioned within the outer channel 130. A nose piece 135 (only one shown) is secured to the center post 122 at both the leading and trailing end of the turbine blade 120 and the nose pieces 135 retain the side pieces 134 within their channels 126 and 130.

The side pieces 134 are dimensioned so that a clearance space is formed between the nose pieces 135, the lower channels 126 and outer channel 130 when the turbine blade 120 is at room temperature. Conversely, at the operating temperature of the turbine, thermal expansion of the side pieces 134 and/or center post 122 substantially eliminates this clearance space thus rigidly securing the side pieces 134 and center post 122 together.

A primary advantage of the turbine airfoil construction of the present invention is the substantial reduction of thermal stresses in the turbine airfoil at the normal operating temperature of the turbine. Consequently, the turbine airfoil construction of the present invention enables the use of higher operating temperatures for the turbine engine without the previously known cracking or fracture of the turbine airfoil. The segmented construction of the airfoil also more evenly distributes the thermal stresses throughout the airfoil at the operating temperature of the engine than has been obtainable with the previously known airfoils.

A still further advantage of the present invention is that different materials can be used for the different segments of the airfoil. For example, since the center post is encased between the side pieces and thus maintained at a lower temperature than the side pieces, less expensive material can be used for the center post where temperature considerations are less critical than for the side pieces.

Having described my invention, however, many modifications thereto will become apparent to those skilled in the art to which it pertains without deviation from the spirit of the invention as defined by the scope of the appended claims.

I claim:

1. A turbine airfoil for use in a high temperature environment comprising:

a center post, at least one side piece, means for loosely attaching said side piece to said center post so that said side piece is carried by said center post and so that, at room temperature, a clearance between said center post and said side piece permits limited relative movement between said center post and said side piece, said clearance being dimensioned so that, at said high temperature, thermal expansion of said center post and/or said piece substantially eliminates said clearance and said limited relative movements between said center post and said side piece.

2. The invention as defined in claim 1 wherein said center post comprises a channel formed along one side, said side piece having a flange positioned within said channel, and wherein said clearance is formed between said channel and said flange.

3. The invention as defined in claim 2 wherein said channel is T-shaped in cross section.

4. The invention as defined in claim 1 wherein said side piece substantially covers one side of said center piece and further comprising a second side piece, means for attaching said second side piece to said first side piece so that at room temperature a further clearance between said side pieces permits limited relative movement between said side pieces, said further clearance being dimensioned so that, at said high temperature, thermal expansion of said side pieces substantially eliminates said further clearance and wherein said second side piece substantially covers the other side of said center post.

5. The invention as defined in claim 4 wherein at least one of said side pieces includes a coolant passageway formed through its interior.

6. The invention as defined in claim 4 and comprising an elongated nose piece, means for securing said nose piece to said side pieces so that, at room temperature, a nose piece clearance between said nose piece and said side pieces permit limited movement between said nose piece and said side pieces and wherein thermal expansion of said nose piece and/or said side pieces at said high temperature substantially eliminates said nose piece clearance.

7. The invention as defined in claim 1 wherein said side piece comprises a plurality of elongated segments and means for securing said segments together to permit limited movement of said segments relative to each other at room temperature and wherein thermal expansion of said segments at said high temperature eliminates said movement between said segments.

8. The invention as defined in claim 1 wherein said center post extends between and is secured to an inner shroud and an outer shroud, and comprising a channel formed in one of said shrouds adjacent said center post, said side piece having an end insertable into said channel and said clearance being formed between said end of said side piece and said channel.

9. The invention as defined in claim 8 wherein said side piece comprises a radially inner segment and a radially outer segment.

10. The invention as defined in claim 1 wherein said airfoil comprises a turbine blade and comprising a root, means for securing one end of said center post to said root, a channel formed in said root along at least one side of said center post, a cap secured to or formed as a part of the other end of the center post, at least one channel formed in said cap adjacent said side of said center post, one end of said side piece being positioned within said root channel and the other end of said side piece being positioned within said cap channel, and wherein said clearance is formed in said channels.

* * * * *